US006991835B2

(12) United States Patent
Sharma et al.

(10) Patent No.: US 6,991,835 B2
(45) Date of Patent: Jan. 31, 2006

(54) INK JET RECORDING ELEMENT

(75) Inventors: Krishamohan Sharma, Rochester, NY (US); Alexandra D. Bermel, Pittsford, NY (US); Joseph F. Bringley, Rochester, NY (US); Christine Landry-Coltrain, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 182 days.

(21) Appl. No.: 10/180,395

(22) Filed: Jun. 26, 2002

(65) Prior Publication Data

US 2004/0001925 A1 Jan. 1, 2004

(51) Int. Cl.
*B41M 5/00* (2006.01)

(52) U.S. Cl. ..... 428/32.36; 428/32.1

(58) Field of Classification Search ..... 347/105; 428/32.18, 32.36, 32.37, 32.15, 32.34, 32.25, 428/32.14, 32.1, 32.26

See application file for complete search history.

(56) References Cited

U.S. PATENT DOCUMENTS 5,372,884 A 12/1994 Abe et al.
5,500,668 A * 3/1996 Malhotra et al. ..... 347/105
2005/0013945 A1 * 1/2005 Bringley et al. ..... 428/32.34
2005/0014000 A1 * 1/2005 Bringley et al. ..... 428/403

FOREIGN PATENT DOCUMENTS

EP 0 965 460 A2 12/1999
EP 1 016 543 A1 7/2000
JP 08109345 * 4/1996

* cited by examiner

*Primary Examiner*—Pamela R. Schwartz

(74) *Attorney, Agent, or Firm*—Harold E. Cole; Chris P. Konkol

(57) ABSTRACT

An ink jet recording element comprising a support having thereon an image-receiving layer, the ink jet recording element containing core/shell particles wherein the shell of the particles consists a metal(oxy)hydroxide complex, $M^{n+}(O)_a(OH)_b(A^{p-})_c \cdot xH_2O$, wherein M is at least one metal ion; n is 3 or 4; A is an organic or inorganic ion; p is 1, 2 or 3; and x is equal to or greater than 0; with the proviso that when n is 3, then a, b and c each comprise a rational number as follows: $0 \leqq a < 1.5$; $0 < b < 3$; and $0 \leqq pc < 3$, so that the charge of the $M^{3+}$ metal ion is balanced; and when n is 4, then a, b and c each comprise a rational number as follows: $0 \leqq a < 2$; $0 < b < 4$; and $0 \leqq pc < 4$, so that the charge of the $M^{4+}$ metal ion is balanced.

19 Claims, No Drawings

INK JET RECORDING ELEMENT

CROSS REFERENCE TO RELATED APPLICATIONS

Reference is made to commonly assigned, co-pending U.S. patent applications:

Ser. No. 10/180,179 by Bringley et al., filed of even date herewith entitled "Ink Jet Recording Element";

Ser. No. 10/180,638 by Sharma et al., filed of even date herewith entitled "Ink Jet Recording Element"; and Ser. No. 10/180,373 by Bringley et al., filed of even date herewith entitled "Ink Jet Printing Method";

Ser. No. 10/180,752 by Sharma et al., filed of even date herewith entitled "Ink Jet Recording Element";

Ser. No. 10/180,184 by Bringley et al., filed of even date herewith entitled "Ink Jet Printing Method";

Ser. No. 10/180,182 by Sharma et al., filed of even date herewith entitled "Ink Jet Recording Element"; and Ser. No. 10/180,187 by Bringley et al., filed of even date herewith entitled "Ink Jet Printing Method".

FIELD OF THE INVENTION

The present invention relates to an ink jet recording element containing core/shell particles which improve stability and optical density.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An ink jet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by coating in which a particulate-containing coating is applied to a support and is dried.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer. Another problem with a porous recording element is that atmospheric gases or other pollutant gases readily penetrate the element and lower the optical density of the printed image causing it to fade.

EP 1 016 543 relates to an ink jet recording element containing aluminum hydroxide in the form of boehmite.

However, there is a problem with this element in that it is not stable to light and exposure to atmospheric gases.

EP 0 965 460A2 relates to an ink jet recording element containing aluminum hydrate having a boehmite structure and a non-coupling zirconium compound. However, there is no specific teaching of a metal oxy(hydroxide) complex as described herein.

U.S. Pat. No. 5,372,884 relates to ink jet recording elements containing a cation-modified acicular or fibrous colloidal silica, wherein the cation-modifier is at least one hydrous metal oxide selected from the group consisting of hydrous aluminum oxide, hydrous zirconium oxide and hydrous tin oxide. However, there is no specific teaching of a metal oxy(hydroxide) complex as described herein for a core/shell particle.

It is an object of this invention to provide an ink jet recording element that, when printed with dye-based inks, provides superior optical densities, good image quality, image stability, and has an excellent dry time.

SUMMARY OF THE INVENTION

This and other objects are achieved in accordance with the invention which comprises an ink jet recording element comprising a support having thereon an image-receiving layer, the ink jet recording element containing core/shell particles wherein the shell of the particles consists of a metal(oxy)hydroxide complex, $$M^{n+}(O)_a(OH)_b(A^{p-})_c \cdot xH_2O,$$

wherein

M is at least one metal ion;

n is 3 or 4;

A is an organic or inorganic ion;

p is 1, 2 or 3; and x is equal to or greater than 0;

with the proviso that when n is 3, then a, b and c each comprise a rational number as follows: $0 \leqq a < 1.5$; $0 < b < 3$; and $0 \leqq pc < 3$, so that the charge of the $M^{3+}$ metal ion is balanced;

and when n is 4, then a, b and c each comprise a rational number as follows: $0 \leqq a < 2$; $0 < b < 4$; and $0 \leqq pc < 4$, so that the charge of the $M^{4+}$ metal ion is balanced.

By use of the invention, an ink jet recording element is obtained that, when printed with dye-based inks, provides superior optical densities, good image quality and has an excellent dry time.

DETAILED DESCRIPTION OF THE INVENTION

In a preferred embodiment of the invention, the core/shell particles consist of a core particle having a negative charge upon its surface and having thereon a shell. Core particles useful in the invention include silica, zinc oxide, zirconium oxide, titanium dioxide, barium sulfate, and clay minerals such as montmorillonite. In a preferred embodiment of the invention, the core particles are negatively charged. One skilled in the art can determine the conditions favorable for inducing a negative charge onto various inorganic or organic particles in such a way that they can be used as core particles for shelling metal (oxy)hydroxides. In a particularly preferred embodiment of the invention, the core particles consist of silica, such as silica gel, hydrous silica, fumed silica, colloidal silica, etc. The size of the core particles may be from about 0.01 to about 10 μm, preferably from about 0.05 to about 1.0 μm.

The shell, as described above, may comprise about 0.1 to about 50% by weight, based upon the weight of the core particle, but is preferably from about 3 to about 40% by weight of the core particle, preferably about 10 to about 30% by weight. The shell may have athickness of about 0.005 to about 0.500 μm, preferably about 0.01 to 0.100 μm thick.

In a preferred embodiment of the invention, the core/shell particles described above are located in the image-receiving layer. In another preferred embodiment, M in the above formula is a Group IIIA, IIIB, IVA, IVB metal or a lanthanide group metal of the periodic chart, such as tin, titanium, zirconium, aluminum, silica, yttrium, cerium or lanthanum or mixtures thereof. In another preferred embodiment, n is 4; a, b and c each comprise a rational number as follows: $0 \leqq a<1$; $1<b<4$; and $1 \leqq pc<4$, so that the charge of the $M^{4+}$ metal ion is balanced. In still another preferred embodiment, a is 0, n is 4, and b+pc is 4. In yet still another preferred embodiment, a is 0, n is 3, and b+pc is 3.

In yet still another preferred embodiment of the invention, $A^{p-}$ is an organic anion such as R—$COO^-$, R—$O^-$, R—$SO_3^-$, R—$OSO_3^-$ or R—O—$PO_3^-$ where R is an alkyl or aryl group. In another preferred embodiment, $A^{p-}$ is an inorganic anionic such as $I^-$, $Cl^-$, $Br^-$, $F^-$, $ClO_4^-$, $NO_3^-$, $CO_3^{2-}$ or $SO_4^{2-}$. The particle size of the complex described above is less than about 1 μm, preferably less than about 0.1 μm.

Metal (oxy)hydroxide complexes employed herein as the shell material may be prepared by dissolving a metal salt in water and adjusting the concentration, pH, time and temperature to induce the precipitation of metal (oxy)hydroxide tetramers, polymers or particulates upon the core material. The conditions for precipitation vary depending upon the nature and concentrations of the counter ion(s) present and can be determined by one skilled in the art. For example, soluble complexes suitable for preparation of the zirconium (oxy)hydroxide shell materials include, but are not limited to, $ZrOCl_2 8H_2O$, and the halide, nitrate, acetate, sulfate, carbonate, propionate, acetylacetonate, citrate and benzoate salts; and hydroxy salts with any of the above anions. It is also possible to prepare the shell materials employed in the invention via the hydrolysis of organically soluble zirconium complexes such as zirconium alkoxides, e.g., zirconium propoxide, zirconium isopropoxide, zirconium ethoxide and related organometallic zirconium compounds.

The hydrolyzed zirconium oxyhydroxides, $$Zr(O)_a(OH)_b(AP^-)_c{*}xH_2O$$

may exist as tetrameric zirconia units or as polymeric complexes of tetrameric zirconia, wherein zirconium cations are bridged by hydroxy and/or oxo groups. In general, hydrolyzed zirconia salts are amorphous and may exist predominantly in the α form. However, depending upon the experimental conditions (solvents, pH, additives, aging and heating conditions), the hydrolyzed product may contain significant number of "oxo" bridges.

It is often difficult to ascertain the precise composition of "oxo" and "hydroxy" groups in hydrolyzed metal salts. Therefore, the usage of definitive numbers for these functional groups in metal (oxy)hydroxide compositions was avoided. Any number of oligomeric or polymeric units of metal complexes may be condensed via hydrolysis reactions to form larger particulates ranging in size from about 3 nm to 500 nm.

It is further possible to age or heat treat suspensions of the core/shell materials to obtain core/shell particulates ranging in size from about 0.500 μm to 5.0 μm. Preferred particles sizes are in the range from about 5 nm to 1000 nm. Calcination of amorphous metal (oxy)hydroxide leads to the formation of crystalline polymorphs of metal oxides.

In a preferred embodiment of the invention, the image-receiving layer is porous and also contains a polymeric binder in an amount insufficient to alter the porosity of the porous receiving layer. In another preferred embodiment, the polymeric binder is a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, or a poly(alkylene oxide). In yet still another preferred embodiment, the hydrophilic binder is poly(vinyl alcohol).

In addition to the image-receiving layer, the recording element may also contain a base layer, next to the support, the function of which is to absorb the solvent from the ink. Materials useful for this layer include particles, polymeric binder and/or crosslinker.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 μm, preferably from about 75 to 300 μm. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an ink jet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include inorganic or organic particles, pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific elements are described in MCCUTCHEON's Volume 1: Emulsifiers and Detergents, 1995, North American Edition.

The image-receiving layer employed in the invention can contain one or more mordanting species or polymers. The mordant polymer can be a soluble polymer, a charged molecule, or a crosslinked dispersed microparticle. The mordant can be non-ionic, cationic or anionic.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples are provided to illustrate the invention.

EXAMPLES

Example 1

Dye Stability Evaluation Tests

The dye used for testing was a magenta colored ink jet dye having the structure shown below. To assess dye stability on a given substrate, a measured amount of the ink jet dye and solid particulates or aqueous colloidal dispersions of solid particulates (typically about 10%–20.0% by weight solids) were added to a known amount of water such that the concentration of the dye was about $10^{-5}$ M. The solid dispersions containing dyes were carefully stirred and then spin coated onto a glass substrate at a speed of 1000–2000 rev/min. The spin coatings obtained were left in ambient atmosphere with fluorescent room lighting (about 0.5 Klux) kept on at all times during the measurement. The fade time was estimated by noting the time required for complete disappearance of magenta color as observed by the naked eye or by noting the time required for the optical absorption to decay to less than 0.03 of the original value.

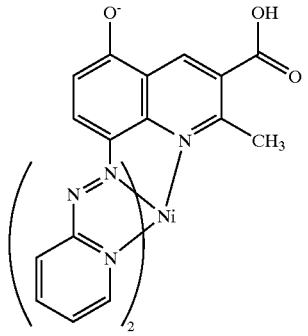

Magenta Dye

Comparative Coatings C-1 to C-2 (Non-Core/Shell Colloidal Particles)

Colloidal dispersions of silica particles were obtained from Nalco Chemical Company. Silica dispersion A had a mean particle size of 112 nm, a pH of 9.6, specific gravity of 1.3 g/ml, and a solids content of 41%. Silica dispersion B had a mean particle size of 94 nm, a pH of 8.4, specific gravity of 1.3 g/ml, and a solids content of 40%. The colloidal dispersions were used as received and coated and tested as described above.

Preparation of Core/Shell Particles

A ZrO(OH)acetate dispersion was obtained from MEI Corporation. The dispersion had 36.5% solids, an average particle size of less than 10 nm, a pH of 3.8 and a specific gravity of 1.3 g/ml. Core/shell colloidal dispersions were prepared by the simultaneous addition of the silica and zirconium colloidal dispersions into a highly efficient mixing apparatus. The colloidal dispersions were introduced via calibrated peristaltic pumps at known flow rates. The mixing efficiencies and flow rates were varied to obtain stable core/shell colloidal dispersions. The details of the preparation and the characteristics of the dispersions are given below. The mixing efficiency of the apparatus is described by the turnover rate, where the turnover rate=(stir rate(rev/min)×turnover volume (ml/rev)) divided by the aqueous volume. The mixing efficiency was kept constant for each example and was about 25 turnovers/min.

Inventive Coatings I-1 to I-12 (Core/Shell Colloidal Particles)

I-1. Into a 2.0 L container containing 200 ml of distilled water which was stirred with a prop-like stirrer at a rate of 200 rpm was simultaneously added silica colloid A at a rate of 20.00 ml/min for 50 minutes and a zirconium (oxy) hydroxy acetate colloid at a rate of 1.2 ml/min. The weight ratio of the resulting colloid was therefore 95% silica and 5% zirconium(oxy)hydroxy acetate. The resulting dispersion had a particle size of 340 nm and settled after standing, indicating that the dispersion was not colloidally stable. The resulting dispersion was then coated and tested as described above and the results shown in Table 1 below.

I-2. This was prepared in an identical manner to that of I-1, except that the zirconium (oxy)hydroxy acetate colloid was added at a rate of 1.8 ml/min. The weight ratio of the resulting colloid was therefore 92.5% silica and 7.5% zirconium(oxy)hydroxy acetate. The resulting dispersion had a particle size of 210 nm and settled after standing, indicating that the dispersion was not colloidally stable. The resulting dispersion was then coated and tested as described above and the results shown in Table 1 below.

I-3. This was prepared in an identical manner to that of I-1, except that the zirconium(oxy)hydroxy acetate colloid was added at a rate of 2.5 ml/min. The weight ratio of the resulting colloid was therefore 90.0% silica and 10.0% zirconium(oxy)hydroxy acetate. The resulting dispersion had a particle size of 145 nm and did not settle after standing, indicating that the dispersion was a stable colloid. The resulting dispersion was then coated and tested as described above and the results shown in Table 1 below.

I-4. This was prepared in an identical manner to that of I-1, except that silica colloid B was substituted in place of colloid A, and the zirconium(oxy)hydroxy acetate colloid was added at a rate of 2.5 ml/min. The weight ratio of the resulting colloid was therefore 90.0% silica and 10.0% zirconium(oxy)hydroxy acetate. The resulting dispersion had a particle size of 151 nm and did not settle after standing, indicating that the dispersion was a stable colloid. The resulting dispersion was then coated and tested as described above and the results shown in Table 1 below.

I-5. This was prepared in an identical manner to that of I-1, except that the zirconium(oxy)hydroxy acetate colloid was added at a rate of 4.0 ml/min. The weight ratio of the resulting colloid was therefore 85.0% silica and 15.0% zirconium(oxy)hydroxy acetate The resulting dispersion had a particle size of 131 nm and did not settle after standing, indicating that the dispersion was a stable colloid. The resulting dispersion was then coated and tested as described above and the results shown in Table 1 below.

I-6. This was prepared in an identical manner to that of I-1, except that the zirconium(oxy)hydroxy acetate colloid was added at a rate of 5.6 ml/min. The weight ratio of the resulting colloid was therefore 80.0% silica and 20.0% zirconium(oxy)hydroxy acetate. The resulting dispersion had a particle size of 130 nm and did not settle after standing, indicating that the dispersion was a stable colloid. The resulting dispersion was then coated and tested as described above and the results shown in Table 1 below.

I-7. This was prepared in an identical manner to that of I-1, except that the zirconium(oxy)hydroxy acetate colloid was added at a rate of 9.3 ml/min. The weight ratio of the resulting colloid was therefore 70.0% silica and 30.0% zirconium(oxy)hydroxy acetate. The resulting dispersion had a particle size of 138 nm and did not settle after standing, indicating that the dispersion was a stable colloid. The resulting dispersion was then coated and tested as described above and the results shown in Table 1 below.

I-8. This was prepared in an identical manner to that of I-1, except that silica colloid B was substituted in place of colloid A, and the zirconium(oxy)hydroxy acetate colloid was added at a rate of 9.3 ml/min. The weight ratio of the resulting colloid was therefore 70.0% silica and 30.0% zirconium(oxy)hydroxy acetate. The resulting dispersion had a particle size of 93 nm and did not settle after standing, indicating that the dispersion was a stable colloid. The resulting dispersion was then coated and tested as described above and the results shown in Table 1 below.

I-9. This was prepared in an identical manner to that of I-1, except that silica colloid B was substituted in place of colloid A, and the zirconium(oxy)hydroxy acetate colloid was added at a rate of 14.5 ml/min. The weight ratio of the resulting colloid was therefore 60.0% silica and 40.0% zirconium(oxy)hydroxy acetate. The resulting dispersion had a particle size of 96 nm and did not settle after standing, indicating that the dispersion was a stable colloid. The resulting dispersion was then coated and tested as described above and the results shown in Table 1 below.

I-10. 1.0 g of colloidal silica dispersion B (median particle size 94 nm) was diluted by the addition of 2.0 ml distilled deionized water. 0.23 g of a 14% (w/w) aqueous dispersion of Yttrium(oxy)hydroxy acetate (median particle size 15 nm) was then added slowly with vigorous stirring. The weight ratio of the resulting colloid was therefore 92.5% silica and 7.5% yttrium(oxy)hydroxy acetate. The resulting dispersion had a particle size of 146 nm and did not settle after standing, indicating that the dispersion was a stable colloid. The resulting dispersion was then coated and tested as described above and the results shown in Table 1 below.

I-11. 1.0 g of colloidal silica dispersion B (median particle size 94 nm) was diluted by the addition of 2.0 ml distilled deionized water. 0.6 g of a 14 % (w/w) aqueous dispersion of Yttrium(oxy)hydroxy acetate (median particle size 15 nm) was then added slowly with vigorous stirring. The weight ratio of the resulting colloid was therefore 82.5% silica and 17.5% yttrium(oxy)hydroxy acetate. The resulting dispersion had a particle size of 139 nm and did not settle after standing, indicating that the dispersion was a stable colloid. The resulting dispersion was then coated and tested as described above and the results shown in Table 1 below.

I-12. 1.0 g of colloidal silica dispersion B (median particle size 94 nm) was diluted by the addition of 2.0 ml distilled deionized water. 1.0 g of a 14% (w/w) aqueous dispersion of Yttrium(oxy)hydroxy acetate (median particle size 15 nm) was then added slowly with vigorous stirring. The weight ratio of the resulting colloid was therefore 74.0% silica and 26.0% yttrium(oxy)hydroxy acetate. The resulting dispersion had a particle size of 154 nm and did not settle after standing, indicating that the dispersion was a stable colloid. The resulting dispersion was then coated and tested as described above and the results shown in Table 1 below.

TABLE 1

| Coating | Silica Core Particle | Core/Shell Ratio | Particle Size (nm) | Stable Colloid | Particle Charge | Fade Time |
|---|---|---|---|---|---|---|
| C-1 | A | 100/0 | 112 | Yes | neg. | 18 h |
| C-2 | B | 100/0 | 94 | Yes | neg. | 18 h |
| I-1 | A | 95/5 | 340 | No | neg./pos. | 1 d. |
| I-2 | A | 92.5/7.5 | 210 | No | neg./pos. | 1 d. |
| I-3 | A | 90/10 | 145 | Yes | pos. | 1 d. |
| I-4 | B | 90/10 | 151 | Yes | pos. | 1 d. |
| I-5 | A | 85/15 | 131 | Yes | pos. | 2 d. |
| I-6 | A | 80/20 | 130 | Yes | pos. | 5 d. |
| I-7 | A | 70/30 | 138 | Yes | pos. | >30 d. |
| I-8 | B | 70/30 | 93 | Yes | pos. | >30 d. |
| I-9 | B | 60/40 | 96 | Yes | pos. | >30 d. |
| I-10 | B | 92.5/7.5 | 146 | Yes | NA | 7 d. |
| I-11 | B | 82.5/17.5 | 139 | Yes | NA | >10 d. |
| I-12 | B | 74/26 | 154 | Yes | NA | >10 d. |

The above data show that the coatings of the invention containing core/shell particles show improved dye stability (longer time for the dye to lose its optical density) when compared with the non-core/shell comparative coatings.

Example 2

Element 1 of the Invention

A coating solution for the base layer was prepared by combining fumed alumina (Cab-O-Sperse® PG003, Cabot Corp.), poly(vinyl alcohol) (Gohsenol® GH-17, Nippon Gohsei Co., Ltd.) and 2,3-dihydroxy-1,4-dioxane (Clariant Corp.) in a ratio of 89:9:2 to give an aqueous coating formulation of 30% solids by weight.

The coating solution for the image-receiving layer was I-4 described above and poly(vinyl alcohol) (Gohsenol® GH-23A, Nippon Gohsei Co.), and mordant polymeric particles of a copolymer of (vinylbenzyl)trimethylammonium chloride and divinylbenzene (87:13 molar ratio), and surfactant Zonyl® FSN (E. I. du Pont de Nemours and Co.) in a ratio of 73/2/20/5 to give an aqueous coating formulation of 10% solids by weight.

The layers were simultaneously bead-coated at 40° C. on polyethylene-coated paper base which had been previously subjected to corona discharge treatment. The image-receiving layer was coated on top of the base layer. The coating was then dried at 60° C. by forced air to yield a two-layer recording element in which the thicknesses of the topmost and bottom layers were 2 $\mu$m and 40 $\mu$m, respectively.

Element 2 of the Invention

Element 2 of the invention was prepared the same as Element 1 except that the ratio of I-4, poly(vinyl alcohol) (Gohsenol® GH-23A, Nippon Gohsei Co.), mordant polymeric particles of a copolymer of (vinylbenzyl)trimethylammonium chloride and divinylbenzene (87:13 molar ratio), and surfactant Zonyl® FSN (E. I. du Pont de Nemours and Co.) was 67/2/26/5.

Comparative Elements C-1 to C-4

Comparative Elements C-1 to C-4 were prepared the same as Element 1 except that fumed alumina (Cab-O-Sperse® PG003, Cabot Corp.) was used in place of the core/shell material. The ratios of fumed alumina (Cab-O-Sperse® PG003, Cabot Corp), poly(vinyl alcohol) (Gohsenol® GH-23A, Nippon Gohsei Co.), mordant polymeric particles of a copolymer of (vinylbenzyl)trimethylammonium chloride and divinylbenzene (87:13 molar ratio), and surfactant Zonyl® FSN (E. I. du Pont de Nemours and Co.) for comparative elements I-4 are listed in Table 2.

Coating Quality

The dried coatings were visually evaluated for cracking defects.

Gloss

The dried coatings were measured for 60° specular glossiness using a Gardener® Gloss Meter. A gloss measurement of at least about 60% is desirable.

Dry Time

Test images of cyan, magenta, yellow, red, green, blue and black bars, each 1.1 cm by 13.5 cm, were printed using an Epson Stylus® Photo 870 using inks with catalogue numbers C13T007201 and C13T008201. Immediately after ejection from the printer, a piece of bond paper was placed over the printed image and rolled with a smooth, heavy weight. Then the bond paper was separated from the printed image. Ink transferred to the bond paper if the recording element was not dry. The length of the bar imaged on the bond paper was measured. The length of the bar imaged on the bond paper was measured and is proportional to the dry time. Dry times corresponding to a length of about 4 cm or less are acceptable.

TABLE 2

| Element | Ratio* | 60° Gloss (%) | Coating Quality | Proportional Dry Time (cm) |
|---|---|---|---|---|
| C-1 | 67/8/20/5 | 70 | no cracking | 0 |
| 1 | 73/2/20/5 | 74 | no cracking | 0 |
| C-2 | 67/2/26/5 | 75 | no cracking | 0 |
| 2 | 67/2/26/5 | 75 | no cracking | 0 |
| C-3 | 67/8/20/5 | 73 | no cracking | 0 |
| C-4 | 73/2/20/5 | 72 | no cracking | 0 |

*Ratio: Particles/polyvinyl alcohol/mordant/Zonyl FSN. ®

The above results show that all elements had good gloss, coating quality and dry time characteristics.

Density Testing

Test images of cyan, magenta, yellow, red, green and blue patches at 100% ink laydown were printed on Elements 1 and 2 of the invention and Comparative Elements I-4 using an Epson Stylus® Photo 870 using inks with catalogue numbers C13T007201 and C13T008201. After drying for 24 hours at ambient temperature and humidity, the Status A densities (red, green, blue and visual channels) were measured using an X-Rite® 820 densitometer as follows:

TABLE 3

| Element | Density Color/Channel | | | |
|---|---|---|---|---|
| | Cyan/Red | Magenta/Green | Yellow/Blue | Black/Visual |
| C-1 | 2.14 | 1.82 | 1.57 | 1.95 |
| 1 | 2.30 | 2.03 | 1.70 | 2.25 |
| C-2 | 2.23 | 1.92 | 1.63 | 1.99 |
| 2 | 2.26 | 2.12 | 1.74 | 2.11 |
| C-3 | 2.15 | 1.89 | 1.60 | 1.97 |
| C-4 | 2.17 | 1.87 | 1.58 | 1.96 |

| | Red/Green | Red/Blue | Green/Red | Green/Blue | Blue/Red | Blue/Green |
|---|---|---|---|---|---|---|
| C-1 | 1.76 | 1.23 | 1.83 | 1.65 | 2.13 | 1.70 |
| 1 | 1.92 | 1.25 | 1.91 | 1.78 | 2.25 | 1.75 |
| C-2 | 1.89 | 1.28 | 1.87 | 1.70 | 2.11 | 1.73 |

TABLE 3-continued

| Element | Density Color/Channel | | | | | |
|---|---|---|---|---|---|---|
| 2 | 2.07 | 1.30 | 1.92 | 1.79 | 2.22 | 1.80 |
| C-3 | 1.83 | 1.25 | 1.81 | 1.67 | 2.08 | 1.74 |
| C-4 | 1.79 | 1.22 | 1.76 | 1.62 | 2.06 | 1.69 |

The data in Table 3 show that Examples 1 and 2 employed in the invention had higher densities than the Comparative Elements C-1 to C-2. Comparative elements C-3 and C-4 demonstrate that the density increase cannot be attributed to the level of poly(vinyl alcohol) present in the coating.

Although the invention has been described in detail with reference to certain preferred embodiments for the purpose of illustration, it is to be understood that variations and modifications can be made by those skilled in the art without departing from the spirit and scope of the invention.

What is claimed is:

1. An unimaged ink jet recording element comprising a support having thereon an image-receiving layer, said ink jet recording element containing core/shell particles wherein said shell of said particles consists of a metal(oxy)hydroxide complex, $$M^{n+}(O)_a(OH)_b(A^{p-})_c.xH_2O,$$

wherein

M is at least one metal ion;

n is 3 or 4;

A is present and is an organic ion or an inorganic ion other than hydroxy;

p is 1, 2 or 3; and x is equal to or greater than 0;

with the proviso that when n is 3, then a, b and c each comprise a rational number as follows: $0 \leqq a < 1.5$; $0 < b < 3$; and $0 < pc < 3$, so that the charge of the $M^{3+}$ metal ion is balanced;

and when n is 4, then a, b and c each comprise a rational number as follows: $0 \leqq a < 2$; $0 < b < 4$; and $0 \leqq pc < 4$, so that the charge of the $M^{4+}$ metal ion is balanced.

2. The recording element of claim 1 wherein said core/shell particles are present in said image-receiving layer.

3. The recording element of claim 1 wherein said core/shell particles are present in an overcoat layer.

4. The recording element of claim 1 wherein M is a Group IIIA, IIIB, IVA, IVB metal or a lanthanide group metal of the periodic chart.

5. The recording element of claim 1 wherein M is tin, titanium, zirconium, aluminum, silica, yttrium, cerium or lanthanum or mixtures thereof.

6. The recording element of claim 1 wherein $A^{p-}$ is an organic anion R—$COO^-$, R—$O^-$, R—$SO_3^-$, R—$OSO_3^-$ or R—O—$PO_3^-$ where R is an alkyl or aryl group.

7. The recording element of claim 1 wherein said core comprises silica.

8. The recording element of claim 1 wherein said metal (oxy)hydroxide complex is prepared from an aqueous dispersion having a pH between about 3 and 10.

9. The recording element of claim 1 wherein M is Zr.

10. The recording element of claim 1 wherein n is 4; a, b and c each comprise a rational number as follows: $0 \leqq a < 1$; $1 < b < 4$; and $1 \leqq pc < 4$, so that the charge of the $M^{4+}$ metal ion is balanced.

11. The recording element of claim 1 wherein the ratio of the core material to the shell material is at least about 95:5.

12. The recording element of claim 1 wherein $A^{p-}$ is present and is $Cl^-$, $NO_3^-$, $CO_3^{2-}$, acetate or propionate.

13. The recording element of claim 1 wherein the particle size of said core/shell particle is less than about 1 $\mu$m.

14. The recording element of claim 1 wherein the particle size of said core/shell particle is less than about 0.1 $\mu$m.

15. The recording element of claim 1 wherein said support is opaque.

16. The recording element of claim 1 wherein said support is transparent.

17. The recording element of claim 1 which also includes a base layer located between said image-receiving layer and said support.

18. An unimaged ink jet recording element comprising a support having thereon an image-receiving layer, said ink jet recording element containing core/shell particles wherein the ratio of core material to shell material is between about 85:15 to about 60:40 and wherein said shell of said particles consists of a metal(oxy)hydroxide complex, $$M^{n+}(O)_a(OH)_b(A^{p-})_c.xH_2O,$$

wherein

M is at least one metal ion;

n is 3 or 4;

A is present and is an organic ion or an inorganic ion other than hydroxy;

p is 1, 2 or 3; and x is equal to or greater than 0;

with the proviso that when n is 3, then a, b and c each comprise a rational number as follows: $0 \leqq a < 1.5$, $0 < b < 3$; and $0 < pc < 3$, so that the charge of the $M^{3+}$ metal ion is balanced;

and when n is 4, then a, b and c each comprise a rational number as follows: $0 \leqq a < 2$; $0 < b < 4$; and $0 \leqq pc < 4$, so that the charge of the $M^{4+}$ metal ion is balanced.

19. An unimaged ink jet recording element comprising a support having thereon an image-receiving layer, said ink jet recording element containing core/shell particles wherein said shell of said particles consists of a metal(oxy)hydroxide complex, $$M^{n+}(O)_a(OH)_b(A^{p-})_c.xH_2O,$$

wherein

M is at least one metal ion;

n is 3 or 4;

A is present and is an organic ion or A is an inorganic ion selected from the group consisting of $I^-$, $Cl^-$, $Br^-$, $F^-$, $ClO_4^-$, $NO_3^-$, $CO_3^{2-}$ and $SO_4^{2-}$;

p is 1, 2 or 3; and x is equal to or greater than 0;

with the proviso that when n is 3, then a, b and c each comprise a rational number as follows: $0 \leqq a < 1.5$; $0 < b < 3$; and $0 < pc < 3$, so that the charge of the $M^{3+}$ metal ion is balanced;

and when n is 4, then a, b and c each comprise a rational number as follows: $0 \leqq a < 2$; $0 < b < 4$; and $0 \leqq pc < 4$, so that the charge of the $M^{4+}$ metal ion is balanced.

* * * * *